US008591288B2

(12) United States Patent
Gogolewski et al.

(10) Patent No.: US 8,591,288 B2
(45) Date of Patent: Nov. 26, 2013

(54) METHOD AND DEVICE FOR MECHANICALLY PROCESSING DIAMOND

(75) Inventors: Przemyslaw Gogolewski, Sint-Genesius-Rode (BE); Guy Van Goethem, Berchem (BE)

(73) Assignee: Wetenschappelijk en Technisch Onderzoekscentrum voor Diamant, Inrichting erkend bij toepassing van de besluitwet van 30 Januari 1947, Lier (BE)

( * ) Notice: Subject to any disclaimer, the term of this patent is extended or adjusted under 35 U.S.C. 154(b) by 549 days.

(21) Appl. No.: 12/741,543

(22) PCT Filed: Nov. 5, 2008

(86) PCT No.: PCT/BE2008/000089
§ 371 (c)(1),
(2), (4) Date: Aug. 17, 2010

(87) PCT Pub. No.: WO2009/059384
PCT Pub. Date: May 14, 2009

(65) Prior Publication Data

US 2010/0304644 A1 Dec. 2, 2010

(30) Foreign Application Priority Data

Nov. 5, 2007 (BE) ..... 2007/0536

(51) Int. Cl.
*B24B 9/16* (2006.01)
*B28D 5/04* (2006.01)

(52) U.S. Cl.
USPC ..... 451/36; 451/104; 125/39

(58) Field of Classification Search
USPC ..... 451/34, 41, 104, 111, 36; 125/39, 30.01
See application file for complete search history.

(56) References Cited

U.S. PATENT DOCUMENTS 3,527,198 A * 9/1970 Takaoka ..... 125/30.01
4,484,418 A 11/1984 Reich et al.

(Continued)

FOREIGN PATENT DOCUMENTS

EP 0347214 A2 12/1989
EP 0354775 A2 2/1990

(Continued)

*Primary Examiner* — Dung Van Nguyen
(74) *Attorney, Agent, or Firm* — Browdy and Neimark, PLLC

(57) ABSTRACT

Method and device for processing a surface (5) of a diamond (1) with a mechanical part (3) which is moved in relation to the surface (5) of the diamond (1), whereby unbound diamond grains (2) are provided in between the mechanical part (3) and the surface (5) of the diamond (1), whereby the mechanical part (3) subjects the diamond grains (2) to a rolling motion over the surface (5) of the diamond (1), such that the diamond grains (2) move in relation to the mechanical part (3) and the surface (5) of the diamond (1), whereby the mechanical part (3) makes a mechanical contact with the surface (5) of the diamond (1) via the diamond grains (2), whereby this mechanical contact represents a contact length (8) over which the diamond grains (2) roll on the surface (5) of the diamond (1), mainly according to the direction of the relative motion of the mechanical part (3) in relation to the surface (5) of the diamond (1) and, whereby the diamond grains (2), with the support of the mechanical part (3), press themselves in the surface (5) of the diamond (1) while rolling, as a result of which microscopic fissures (6) are created in the latter surface (5) which then gradually crumbles off.

9 Claims, 3 Drawing Sheets

(56) References Cited

U.S. PATENT DOCUMENTS

| | | | | | |
|---|---|---|---|---|---|
| 5,367,837 | A | * | 11/1994 | Tolkowsky | 451/389 |
| 5,755,614 | A | * | 5/1998 | Adams et al. | 451/60 |
| 6,039,631 | A | * | 3/2000 | Sato et al. | 451/37 |
| 6,068,542 | A | | 5/2000 | Hosokai | |
| 7,192,337 | B2 | * | 3/2007 | Shuto | 451/41 |
| 7,228,856 | B2 | * | 6/2007 | Aoyagi | 125/30.01 |

FOREIGN PATENT DOCUMENTS

| | | | |
|---|---|---|---|
| GB | 799498 | A | 8/1958 |
| GB | 2255923 | A | 11/1992 |
| JP | 59-069257 | A | 4/1984 |
| JP | 09-248757 | A | 9/1997 |
| JP | 10-034514 | A | 10/1998 |

* cited by examiner

METHOD AND DEVICE FOR MECHANICALLY PROCESSING DIAMOND

The invention concerns a method and device for mechanically processing the surface of a diamond.

According to the present state of the art, diamond is mechanically processed in different ways, such as for example cleaving, sawing, cutting and polishing.

In all these known mechanical processing methods, use is made of tools such as a disc or saw blade on which a diamond or diamond grains are fixed which are being drawn or pushed over the surface of the diamond to be processed by said tools.

When conventionally shaping and polishing diamonds, an abrasive powder, formed of loose, unbound diamond grains, is provided on a rotating cast iron disk/scaif together with some oil. The diamond grains are mechanically processed inside the pores of the cast iron, as a result of which they are bound and plough into the surface of the diamond to be processed. The patent applications EP 0354775 A, GB 2255923 A and U.S. Pat. No. 4,484,418 A describe cast iron disk/scaif on which diamond grains are bound for polishing diamonds in a conventional way.

This conventional processing method is very comparable to the lapping of mechanical parts whereby an abrasive powder is provided together with some oil on a rotating cast iron disk, for example, and is mechanically immobilised in the pores of the cast iron.

Apart from the fact that diamond is very hard to be processed, the efficiency of the known mechanical processing operations strongly depends on the orientation of the diamond's crystalline structure in relation to the processing direction. Some processing operations are excluded in certain directions and other processing operations each time require a suitable processing direction to be determined by experiment. This restricts and complicates the processing operation and has an impact on the production time and the required degrees of freedom of the used machines and tools.

Thus, when polishing diamond, the removal rate, which is the speed at which diamond material of the diamond to be processed is removed, will strongly depend on the orientation of the processing direction in relation to the orientation of the crystal. Further, the mechanical processing of polycrystalline diamond, in which the crystals have different orientations, is very hard.

The invention aims to remedy these disadvantages by providing a method for mechanically processing diamond whereby the processing is almost independent from the orientation of the processing direction in relation to the orientation of the crystal and whereby there are no further restrictions related to the origin (for example natural, HPHT-grown or CVD diamond), the field of application (for example gem diamond, industrial diamond or diamond for electronic applications), the external geometry or the quality (for example monocrystalline or polycrystalline diamond) of the diamond to be processed.

To this aim, unbound diamond grains are provided between a mechanical part and the surface of the diamond, whereby the diamond grains are subjected to a rolling motion such that the diamond grains move in relation to the mechanical part and the surface of the diamond over said surface. The mechanical part hereby makes a mechanical contact with the surface of the diamond via the diamond grains. Said mechanical contact has a contact length over which the diamond grains roll over the surface of the diamond according to mainly the direction of the relative motion of the mechanical part in relation to the diamond's surface. Thus, the diamond grains, with the support of the mechanical part, press into the surface of the diamond while rolling, thus creating microscopic fissures in the surface, as a result of which the latter will gradually crumble off.

Practically, the diamond grains are supplied in a fluid which is provided between the diamond and the mechanical part.

In an advantageous manner, the diamond grains are moved between the mechanical part and the surface of the diamond over a contact length which is at least 3 times, preferably at least 30 times the diameter of the diamond grains.

The diamond grains preferably have an irregular shape with an average diameter between 1 μm and 100 μm.

The invention also concerns a device for processing the surface of a diamond according to the method of the invention, whereby the mechanical part has a contact surface on which unbound diamond grains in a fluid are present that can roll over this surface when the mechanical part is being moved with respect to the diamond to be treated, when the latter rests on the unbound diamond grains.

The mechanical part can, for example, consist of a cast iron or plastic disk which turns in part or as a whole in a water/oil emulsion with loose, unbound diamond grains.

Other particularities and advantages of the invention will become clear from the following description of a practical embodiment of the method and the device according to the invention; this description is merely given as an example and does not restrict the scope of the claimed protection in any way; the figures of reference used hereafter regard the enclosed drawings.

Figure 4:
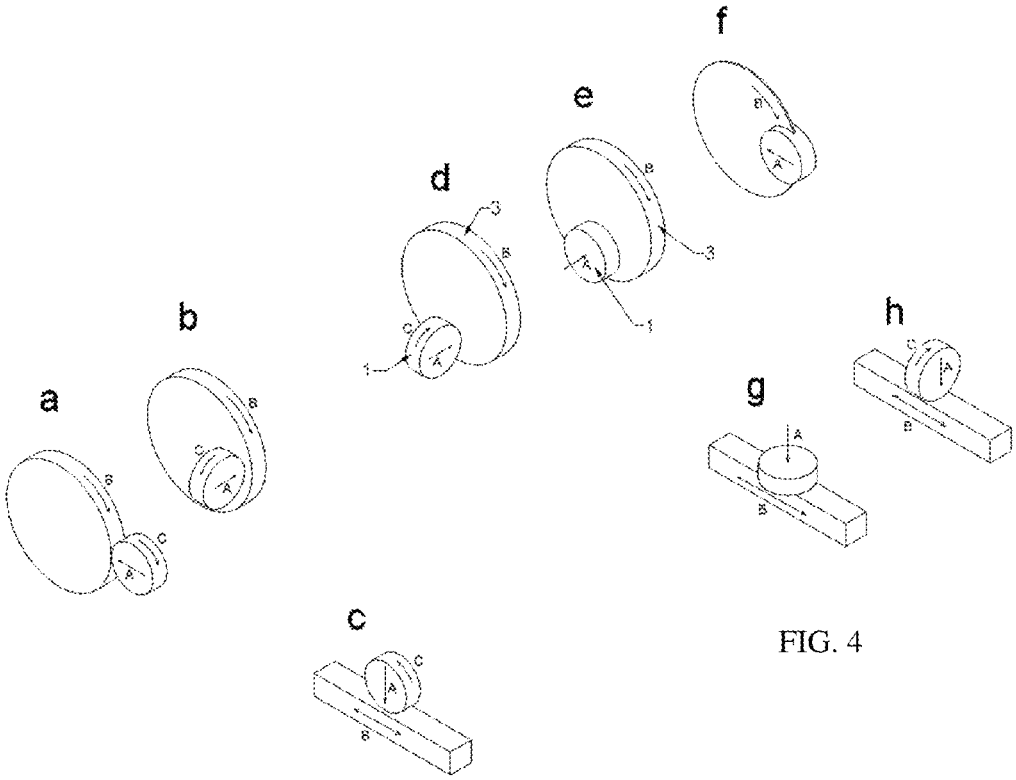

FIGS. 4*a* to 4*c* included are a series of schematic representations of other possible arrangements of devices which do not work according to the method of the invention or at least not optimally.

FIGS. 4*d* to 4*h* included are a series of schematic representations of possible further arrangements of devices that work according to the method of the invention.

Figure 5:
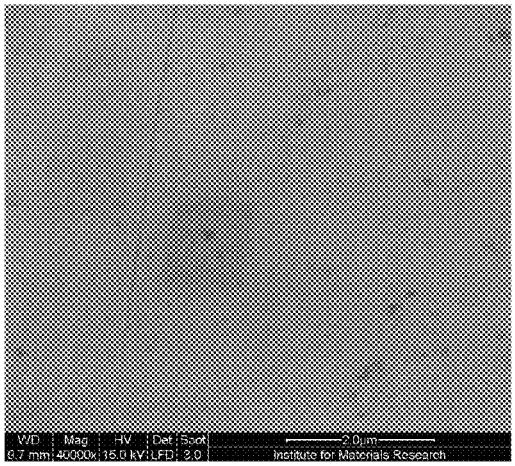

FIG. 5 is a 40,000 times enlargement of the surface of a processed diamond according to the state of the art whereby diamond grains that are bound to a mechanical part are used.

Figure 6:
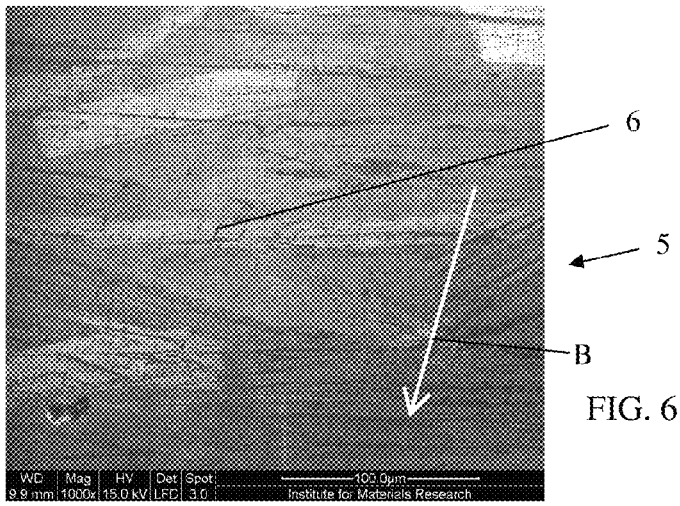

FIG. 6 is a 1,000 times enlargement of a pre-polished surface of a diamond which was processed according to the method of the invention and whereby a low concentration of diamond grains was used.

Figure 7:
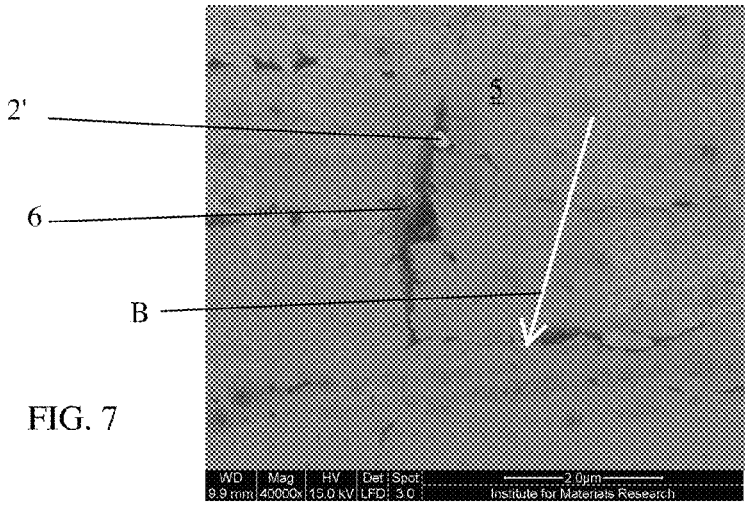

FIG. 7 is a detail of FIG. 6 with a 40,000 times enlargement of the surface of a processed diamond.

Figure 8:
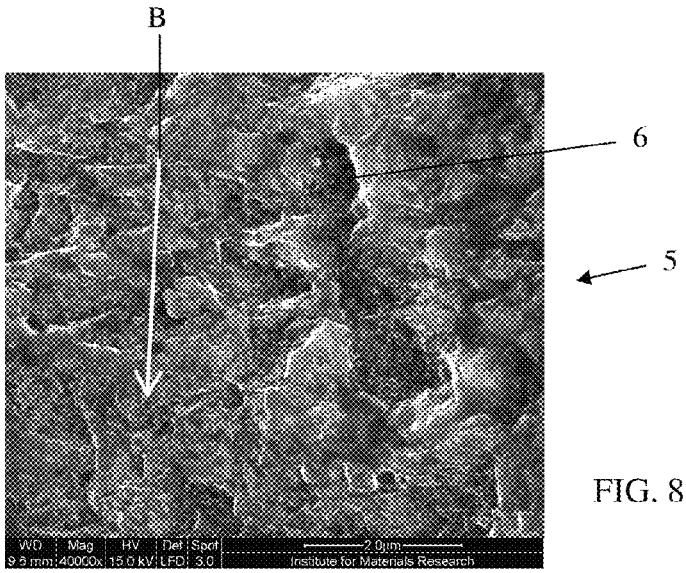

FIG. 8 is a 40,000 times enlargement of the surface of a processed diamond according to a method of the invention whereby a high concentration of diamond grains was used.

In the different drawings, the same figures of reference regard identical or analogous elements.

Figure 1:
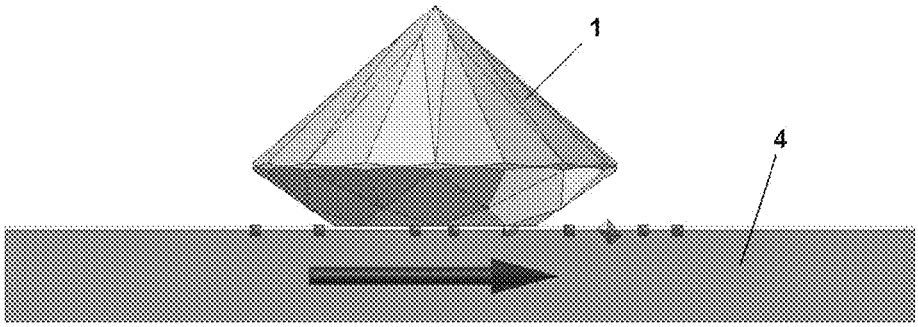
FIG. 1 is a schematic representation of an arrangement of a device according to the state of the art whereby immobilised diamond grains have been worked into a mechanical part.

In the existing methods for mechanical processing of diamond, use is either made of diamond grains that are bound in a mechanical part 4, such as a rotating disk, or measures are taken to bind free grains as efficiently as possible, as is for example represented in FIG. 1.

Figure 2:
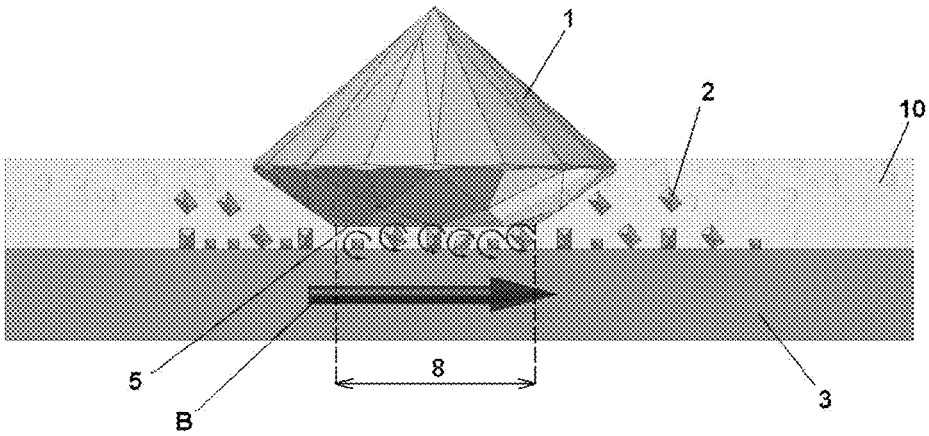
FIG. 2 is a schematic representation of an arrangement of a device according to the invention whereby diamond grains roll over the surface of the diamond and press into said surface with the support of the mechanical part.

As opposed to that, the method according to the invention, as is schematically represented in FIG. 2, uses diamond grains 2 that are not bound to a solid support but that are carried by a fluid 10, such as a liquid or gas. In this method, free unbound diamond grains 2 must be necessarily available.

Figure 3:
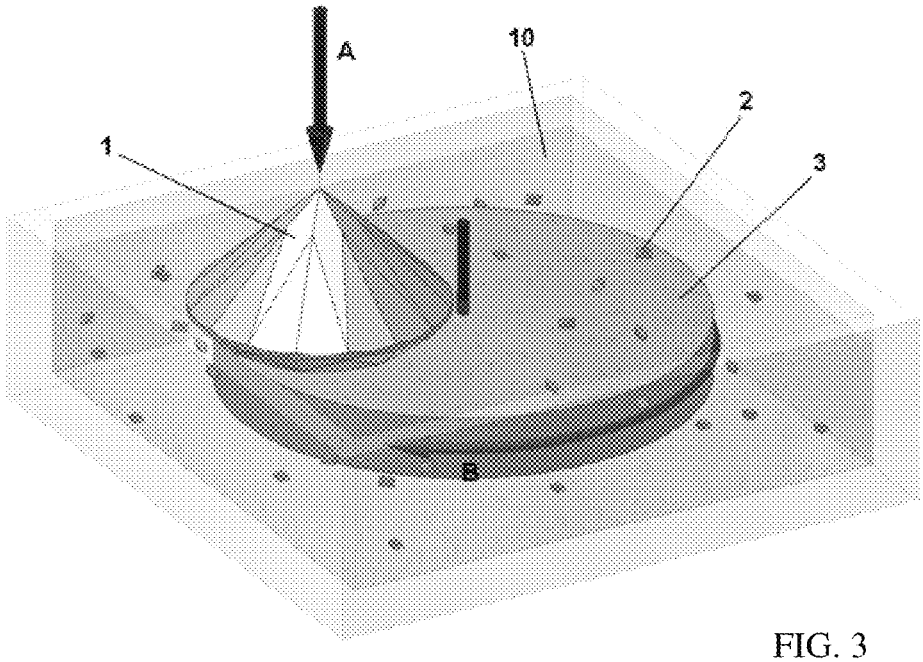
FIG. 3 is a schematic representation of a practical arrangement of a device according to the invention whereby the mechanical part is formed of a disk rotating in a fluid with diamond grains.

According to a possible practical embodiment of the method according to the invention, as represented in FIG. 3, a diamond 1 is moved towards a mechanical part 3 according to a feed direction A to thus make a mechanical contact with it in a certain contact zone via diamond grains 2 which are provided between the diamond 1 and the part 3.

The mechanical part 3 is moved in relation to the diamond 1 according to the direction B. The unbound diamond grains 2 are thereby provided between the diamond 1 to be processed and the mechanical part 3.

Thanks to the relative motion B of the mechanical part 3 in relation to the surface 5 of the diamond 1, the unbound diamond grains 2 are subjected to a rolling motion in the contact zone over the mechanical part 3 and between the mechanical part 3 and the surface 5 of the diamond 1. As a consequence, the unbound diamond grains 2 will move almost freely over the surface 5 of the diamond 1, predominantly in the direction of the relative motion B of the mechanical part 3 in relation to the surface 5 of the diamond 1.

It is important that the mechanical part 3 makes contact with the surface 5 of the diamond 1 to be processed via the diamond grains 2 and that this contact is made over a certain contact length 8 according to the relative direction of motion B of the mechanical part 3 in relation to the surface 5 of the diamond 1 to be processed.

The contact length 8 hereby represents the distance on the surface 5 of the diamond 1 to be processed over which the mechanical part 3 makes contact with the surface 5 of the diamond 1 to be processed via the unbound diamond grains 2 according to the direction of the relative motion of the mechanical part 3 in relation to the surface 5 of the diamond 1 to be processed.

This contact length 8 almost corresponds to the distance over which the hard diamond grains 2 are guided or rolled between the mechanical part 3 and the surface 5 of the diamond 1 to be processed, or, in other words, the distance which the diamond grains 2 travel over the surface 5 of the diamond 1 to be processed between the mechanical part 3 and the surface 5 of the diamond 1 to be processed.

The distance which the grains 2 travel over the surface of the mechanical part 3 is not necessarily equal to the contact length 8, but it may be larger than the contact length 8 over the surface 5 of the diamond 1.

The diamond grains 2 are preferably not perfectly spherical, but they have an irregular shape with variable diameters, which consequently deviates from a sphere, such that during the rolling motion, said grains 2 do not constantly make contact with both surface 5 of the diamond 1 and the mechanical part 3.

The relative motion of the mechanical part 3 procures a speed to the diamond grains 2 as a result of which said grains 2 will hit the surface 5 of the diamond 1 during the rolling motion and/or as a result of which also protruding parts of the grains 2 will work their way into the surface 5 of the diamond 1 with the support of the mechanical part 3. In this way micro-fissures 6 are created in the surface 5 of the diamond 1.

Since the diamond grains 2 are not perfectly spherical, they will press themselves into the surface 5 of the diamond 1 during the rolling motion, with the support of the mechanical part 3, as a result of which micro-fissures or cracks 6 are created in the surface 5.

By way of example, an enlargement with a factor 1,000 of a pre-polished surface 5 of a diamond 1 is represented in FIG. 6, which was processed afterwards with a low mass concentration (<1% (g/100 ml)) of diamond grains 2. In this surface 5 we can clearly see micro-fissures 6 which have been produced by the rolling diamond grains 2. These fissures 6 mainly extend in the direction of the relative motion B between the diamond 1 to be processed and the mechanical part 3. Additionally, also fissures in other directions are created. A detail of a micro-fissure 6 with a times 40,000 enlargement is represented in FIG. 7. A broken fragment 2' of an impressed free diamond grain 2 is visible in the micro-fissure 6.

Due to the damaged surface 5 showing micro-fissures 6, parts of said surface 5 are broken out, as a result of which a layer of material is removed. By reducing the distance between the diamond 1 and the mechanical part 3 during the process, diamond grains 2 will always press themselves into the contact zone, such that material of the surface 5 of the diamond 1 concerned can be removed layer after layer. The removed material can in turn be used as a new supply of diamond grains 2.

FIG. 8 represents a times 40,000 enlargement of the surface 5 of a diamond 1 which was processed with a high concentration of free diamond grains 2. Said surface 5 shows traces of removed pieces of diamond as a result of a large number of fissures 6 produced by the rolling grains 2.

As opposed to bound grains as used in for example a diamond-coated polishing disk, the unbound grains 2 do not follow a fixed path over the surface 5 of the diamond 1, but they more or less follow the path of the relative motion of the mechanical element in relation to the diamond, as a result of which small cracks 6 will be produced in the surface 5 in arbitrary places.

What is characteristic of the use of bound grains, such as when traditionally polishing diamonds, is that they cause straight polishing lines and/or grooves in the surface 5 of the diamond 1 according to the polishing direction, as represented in FIG. 5. Consequently, the polishing direction is clearly visible. However, in the surface 5 of a diamond 1 which has been processed according to the method of the invention as represented in FIG. 8, the polishing direction is no longer clearly visible.

As small cracks 6 are formed by the unbound diamond grains 2 with the method according to the invention instead of polishing lines and/or grooves by bound diamond grains, the method no longer depends on the orientation or processing direction in relation to the orientation of the crystal structure.

Thus, it is of major importance that the diamond grains 2 do not adhere to the mechanical part 3 as when conventionally polishing diamond or when lapping metal. Diamond grains 2 which are nevertheless immobilized in the mechanical part 3 will no longer have an active part in the process since they can no longer make contact with the surface 5 of the diamond 1. As a result, these bound grains 2 can no longer work the surface 5 of the diamond 1.

Different parameters influence the rolling motion of the diamond grains 2 between the mechanical part 3 and the diamond 1 to be processed. These parameters can be determined and optimised depending on the arrangement. Thus, the process is influenced by, for example, the grain size of the diamond grains 2, the roughness and the material of the mechanical part 3 and the size or the relative speed of the mechanical part 3 in relation to the diamond 1. The roughness of the mechanical part 3 is for example preferably smaller than the average diameter of the diamond grains 2. The surface of the mechanical part 3 is preferably somewhat elastically deformable as well to restrict its wear.

The removal rate and quality of the obtained surface 5 of the diamond 1 can be influenced by the used grain size, geometry and concentration of the grains 2 in the medium 10. Thus, the removal rate will increase in case of a higher concentration of grains 2. Preferably, according to the method of the invention, there are at least 1 and in particular at least 10 unbound grains 2 per $mm^2$ of contact surface between the mechanical part 3 and the surface 5 of the diamond 1.

In the practical embodiment of a device according to the invention, as represented in FIG. 3, use is made of a mechanical part 3 formed of a cast iron disk 3 rotating in a water/oil emulsion 10 with loose diamond grains 2. The mass concentration of grains 2 is 23% or 230 g of diamond grains 2 per liter of water/oil emulsion 10. The loose diamond grains have a diameter of 4 to 26 μm and they are carried along together with the water/oil emulsion 10 by the revolving motion B of the disk 3. Thus, the loose diamond grains 2 in the water/oil emulsion 10 end up between the disk 3 and the diamond 1. The peripheral velocity $v_s$ of the disk preferably amounts to some 14 $m \cdot s^{-1}$. The diamond 1 to be processed is fixed on a mechanical support, not represented in the figures, which provides for the feed motion A. The surface 5 of the diamond 1 to be processed is moved towards the disk 3. The disk 3 rotates in the emulsion 10 with loose diamond grains 2, as a result of which said disk 3 makes contact via the loose grains 2 with the surface 5 of the diamond 1. The loose diamond grains 2 are forced to roll over the surface 5 of the diamond 1 to be processed by the relative motion of the disk 3 in relation to the diamond 1. As these diamond grains 2 are not perfectly spherical, they will produce micro-fissures 6 in the surface 5 to be processed while rolling. In case of a massive number of micro-fissures 6, a flat surface will be obtained on a diamond 1 with the disk 3. This makes it possible to form surfaces, for example in monocrystalline diamonds, without looking for a suitable processing direction in relation to the orientation of the crystal lattice.

The method according to the invention further is advantageous in that the removal rate for the surface of the diamond to be processed is on average higher for all the crystal directions than with the conventional processing methods, in that the mechanical part can be easily manufactured at a low cost since it must not contain any bound diamond grains, in that the relative speed of the mechanical part in relation to the diamond to be processed can be much lower than the conventional cutting speeds of the known conventional processing methods for diamond, in that polycrystalline diamonds having different crystal orientations can be easily processed, in that the number of required degrees of freedom for the machines is smaller since the crystal direction of the diamond is no longer important, in that the diamond material which has been removed from the surface of the diamond to be processed can be used as an active grain in the fluid, and in that the increase in temperature of the diamond to be processed is much smaller than with most existing mechanical processes, as a result of which the risk of damages is much smaller.

The processing according to the invention can be applied to any possible diamond processing applications whereby there is a certain contact length according to the relative direction of movement between the diamond 1 to be processed and a mechanical part 3 during the processing. FIGS. 4*d* to 4*h* thus schematically represent some possible arrangements for a mechanical part 3 and a diamond 1 to be processed. The contact between the mechanical part 3 and the surface 5 of the diamond 1 can be made via a flat or bent surface of a curved or straight line. In FIGS. 4*d* and 4*h*, said contact is a line contact, whereas in FIGS. 4*e*, 4*f* and 4*g* said contact consists of a flat or bent contact surface.

As already described above, in these arrangements, the diamond 1 was supplied to the mechanical part 3 according to a feed direction A, to thus, via the diamond grains 2 provided in between, make contact with the part 3. The mechanical part 3 is moved in relation to the diamond 1 according to the direction B and, depending on the processing action, the diamond 1 is also moved according to the direction C. Consequently, the motion according to the direction C will also determine the relative motion of the mechanical-part 3 in relation to the surface 5 of the diamond 1.

If there is a line contact between the diamond 1 to be processed and the mechanical part 3, perpendicular to the relative motion, as represented in FIGS. 4*a*, 4*b* and 4*c*, the principle is not optimally applicable or not applicable at all since the loose grains 2 will not start to roll between the diamond 1 to be processed and the mechanical part 3.

If, in the arrangements represented in FIGS. 4*a*, 4*b* and 4*c*, the speed of movement according to the direction C is set low, these arrangements will switch to a workable condition since the process gets the chance to maintain a contact length 8 according to the relative direction of movement of the mechanical part 3 in relation to the surface 5 of the diamond 1 to be processed. In this case, there is no more line contact at right angles to the relative motion. The rotational speed in the direction C, at which a workable condition is created, further depends on the used grain size of the diamond grains 2 and the concentration of said diamond grains 2 in the fluid 10.

The arrangement as represented for example in FIG. 4*a* is not a workable arrangement according to the invention at rotational speeds of the diamond 1 in the direction C which are larger than 0.5 rotations per minute with the following limiting conditions: the diameter of the diamond 1 amounts to 4.5 mm; the mechanical part 3 consists of a PVC disk having a diameter of 170 mm; the peripheral velocity of said disk amounts to 14 $m \cdot s^{-1}$; the disk rotates in a water/oil emulsion with a mass concentration of 20% (g/100 ml) of diamond grains 2; the diamond grains 2 have a diameter which amounts to 4 to 26 μm. The girdle or the cylindrical part of a diamond 1 cannot be cut according to the method of the invention with the arrangement of FIG. 4*a* at a rotational speed of more than 0.5 rotations per minute, or only with great difficulty.

The device according to the invention comprises a frame, not represented in the figures, on which a mechanical part 3 is fixed. This mechanical part 3 can be in the shape of a disk and has a contact surface that can be from cast iron or plastic. Preferably, the contact surface contains less that one bound diamond grain per $mm^2$. Preferably, this is less than one grain per 10 $mm^2$ and even less than one grain per 100 $mm^2$. Diamond grains that are possibly bound to the contact surface preferably do not actively take part in the processing because they do not make direct contact with the diamond 1 to be treated.

The device according to the invention contains by preference on the frame a circulation system for the diamond grains 2, which passively or actively circulates said grains in a fluid. A passive circulation system can consist, for example, of a bath with a fluid, such as a water/oil emulsion, in which diamond grains 2 are present. The unbound diamond grains 2 are captured in the bath. Because the contact surface of the mechanical part 3 is moving partially or as a whole in the bath, diamond grains 2 are carried by the contact surface. An active circulation system can consist, for example, of a pump that circulates the captured diamond grains 2 in a fluid to bring them again onto the contact surface. Preferably, the circulation system allows, for example, to capture diamond grains 2 which leave the contact surface and to bring them back onto the contact surface.

Further, the device also contains a clamping system that is connected to the frame for clamping the diamond to be treated such that it can be moved in a desired position with respect to the mechanical part 3. Preferably, the clamping device allows to subject the diamond to a linear and/or rotational movement with respect to the contact surface of the mechanical part 3. The clamping device may be fixed to the frame by fixing means that allow such a movement.

Naturally, the invention is not restricted to the above-described method and the devices represented in the accompanying figures.

Thus, the mechanical part may be formed of a plastic disk made of, for example, PVC or POM.

Thus, the mechanical part 3 may be partly covered with bound diamonds or diamond grains 2 which do not make any direct contact with the surface 5 of the diamond 1 and thus do not have an active part in the working process.

The invention claimed is:

1. Method for processing a surface (5) of a diamond (1) with a mechanical part (3) which is moved in relation to the surface (5) of the diamond (1), wherein (i) unbound diamond grains (2) are provided in between the mechanical part (3) and the surface (5) of the diamond (1), (ii) the mechanical part (3) subjects the diamond grains (2) to a rolling motion over the surface (5) of the diamond (1), such that the diamond grains (2) move in relation to the mechanical part (3) and the surface (5) of the diamond (1), (iii) the mechanical part (3) makes a mechanical contact with the surface (5) of the diamond (1) via the diamond grains (2), whereby this mechanical contact represents a contact length (8) over which the diamond grains (2) roll on the surface (5) of the diamond (1), the rolling of the diamond grains (2) being influenced by the grain size of the diamond grains (2) and the roughness and material of the mechanical part (3) and, (iv) the diamond grains (2), with the support of the mechanical part (3), press themselves in the surface (5) of the diamond (1) while rolling, as a result of which microscopic fissures (6) are created in the latter surface (5) which then gradually crumbles off.

2. Method according to claim 1, wherein the unbound diamond grains (2) are supplied in a fluid (7) which is provided between the surface (5) of the diamond (1) and the mechanical part (3).

3. Method according to claim 1, wherein the diamond grains (2) are moved between the mechanical part (3) and the surface (5) of the diamond (1) over a contact length (8) which amounts to at least 3 times, preferably at least 30 times the diameter (9) of the diamond grains (2).

4. Method according to claim 1, wherein the diamond grains (2) have an arbitrary shape with a grain size between 1 μm and 100 μm.

5. Method according to claim 1, wherein the mechanical part (3) is moved in relation to the surface (5) of the diamond (1) at a speed which is lower than 40 $m \cdot s^{-1}$.

6. Method according to claim 1, wherein the mechanical part (3) is partly covered with bound diamonds or diamond grains which do not make any direct contact with the surface (5) of the diamond (1), such that they do not have an active part in the working process.

7. Method according to claim 1, wherein the mechanical part (3) is formed of a cast iron or plastic disk.

8. Method according to claim 1, wherein the mechanical part (3) rotates at least partly in a water/oil emulsion (10) with unbound diamond grains (2).

9. Device for processing a surface (5) of a diamond (1) according to a method of claim 1, that contains diamond grains (2) and a frame with a mechanical part (3), whereby the mechanical part (3) can move in relation to the frame such that through the diamond grains (2) contact is made with the surface (5) of the diamond (1) to be treated, wherein the mechanical part (3) has a contact surface on which unbound diamond grains (2) are present in a fluid, which can roll over this surface when the mechanical part (3) is moved in relation to the surface (5) of the diamond to be treated when the latter rests upon said unbound diamond grains (2), the roughness of the mechanical part (3) is smaller than the average diameter of the diamond grains (2), wherein said device further comprises a clamping system that is in connection with the frame for clamping the diamond (1) and that allows to move the diamond with the surface (5) to be treated towards the mechanical part to make contact with the unbound diamond grains (2) that are present in the fluid on the contact surface of the mechanical part (3), wherein said device comprises a circulation system that is fixed to the frame and that comprises a fluid (7) for bringing unbound diamond grains onto the contact surface of the mechanical part (3), said circulation system installed to capture diamond grains (2) which leave the contact surface and to bring them back onto this contact surface.

* * * * *